United States Patent [19]

Boothe

[11] 3,979,784

[45] Sept. 14, 1976

[54] ADAPTOR

[76] Inventor: Richard A. Boothe, Box 4996, Aspen, Colo. 81611

[22] Filed: Oct. 2, 1975

[21] Appl. No.: 618,766

Related U.S. Application Data

[63] Continuation of Ser. No. 374,699, Nov. 26, 1973, abandoned.

[52] U.S. Cl. ..... 5/343

[51] Int. Cl.[2] ..... A47G 9/00

[58] Field of Search ..... 5/343, 344, 347

[56] References Cited

UNITED STATES PATENTS

| | | | |
|---|---|---|---|
| 2,637,048 | 5/1953 | Peters | 5/343 |
| 2,972,757 | 2/1961 | Adrian | 5/343 |
| 3,372,407 | 3/1968 | Weber | 5/347 |
| 3,408,667 | 11/1968 | Rajakaruna | 5/347 X |
| 3,584,323 | 6/1971 | Worley | 5/343 |
| 3,787,906 | 1/1974 | Hunt | 5/343 |

*Primary Examiner*—Paul R. Gilliam
*Assistant Examiner*—Andrew M. Calvert
*Attorney, Agent, or Firm*—Reilly and Hancock

[57] ABSTRACT

An adaptor pad is devised for use with sleeping bags, particularly those commonly referred to as mummy bags, in which the mummy bag can be unfolded and the zipper edges wrapped or folded over the opposite side edges of the adaptor pad and removably secured to zipper sections at or beneath the side edges of the adaptor pad. The pad is so constructed and arranged as to permit its use either with a single or double panel portion of a sleeping bag to provide sleeping accommodations for one or two persons, respectively.

6 Claims, 10 Drawing Figures

ADAPTOR

This is a continuation of prior application Ser. No. 374,699, filed Nov. 26, 1973, now abandoned.

SUMMARY

This invention relates to sleeping bags and more particularly to an adaptor or pad especially designed to zip to or otherwise be fastened into a single sleeping bag thereby converting it to a double bag, and which may be zipped or fastened to itself creating a single bag for children, and which incorporates a special safety device to prevent the seams from bursting when washed, and which, with an accessory "insert", may be used as a single sleeping bag for adults.

This invention is a new item in the sleeping bag field, which in a preferred form is adapted to zip into a conventional mummy bag which has been unzipped and unfolded so as to double the size of the bag and provide a comfortable, warm sleeping pad under and as an integral unit with the unzipped down mummy bag. This configuration approximates what is commonly known as a double mummy bag while dispensing with accessory sleeping pads.

In the alternative, the pad may be employed with a panel portion approximating one-half of a sleeping bag, but provided with a zipper section circumscribing opposite side edges and the end edge of the panel portion so that when zipped or otherwise secured to the pad will form a single mummy bag. Modifications of the pad permit utilization of a special draft flap between the pad and mummy bag or other sleeping bag at the zipper section; and other modifications permit a more secure zipper construction with a double layer pad for increased comfort and warmth.

It is therefore an object of this invention to provide a comfortable sleeping arrangement for two or more people, making use of a standard mummy bag, readily available on the market, and which may be used separately as a child's sleeping bag, or as a full length sleeping pad for one or two people, or zipped to another "adaptor" as a large bag for several children.

It is another object of the present invention to provide a special down "insert" which may also be zipped to the adaptor creating a single mummy bag.

It is a further object of the present invention to provide for a cushioned adaptor pad so constructed and arranged as to facilitate attachment to a sleeping bag in accommodating one or more persons and in such a way as to minimize drafts and to provide for an extremely compact adaptor pad which can be readily folded or rolled into a small package for carrying purposes.

It is a still further object of the present invention to provide for an adaptor pad conformable for use with various types of sleeping bags to permit conversion of a sleeping bag from a single to double bag in a novel and improved manner; and further to provide for novel and improved interconnection between the adaptor pad and sleeping bag with or without a draft flap interposed between the pad and sleeping bag at or along the point of interconnection.

The foregoing and other objects, features and advantages of the present invention will be readily apparent in view of the following detailed description of the preferred embodiment.

DETAILED DESCRIPTION OF THE PREFERRED EMBODIMENT

Referring in detail to the drawings, there is shown in FIGS. 1 to 3, 5 and 6 a preferred form of adaptor A which is specifically conformable for use with sleeping bags represented at 3, the sleeping bag 3 being of a type conventionally referred to as a "mummy bag".

As a setting for the present invention, the standard sleeping bag has generally rectangular panel portions folded along a common longitudinal edge into superimposed relation to one another with removable fastener means extending at least along the opposite coextensive longitudinal edges and end edges for releasably securing said panel portions together. Specifically in the case of mummy bags, as noted from FIGS. 2 and 3, the panel portions are tapered toward the foot end and the removable fastener means or zipper 2 extend only along the coextensive longitudinal edges and terminate at the foot end of the bag. Thus, when unzipped and unfolded as illustrated in FIG. 3, the mummy bag has zipper portions extending along the separated longitudinal edges; and of course when unfolded will greatly increase the effective size of the mummy bag for utilization in combination with the preferred form of adaptor A now to be described.

Figure 5:
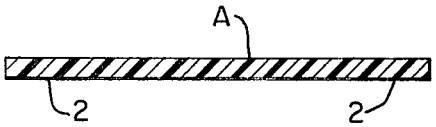
FIG. 5 is a cross-sectional view showing the placement of the zipper on the adaptor.
Figure 6:
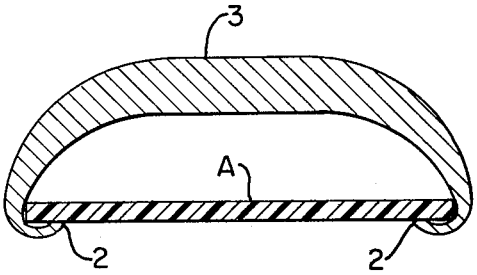
FIG. 6 is a cross-sectional view of the adaptor with the mummy bag zipped to it.

The adaptor is preferably composed of a resilient or flexible cushion material and for example may be composed of a thin foam cushion pad encased in a fabric cover, as illustrated in FIGS. 5 and 6. In configuration, the pad includes a relatively wide, generally rectangular portion extending from the head end of the pad for its greater length and terminating in a tapered portion toward the foot end so as to generally conform in configuration to that of a zipped mummy bag. A conventional type of drawstring 1 is affixed to the head end of the bag so as to extend completely around the head end surface and a portion of the sides whereby to permit tightening to draw the pad at its head end into the form of a hood very much in the manner that is done with a mummy bag. Further, the adaptor pad is provided with a removable fastener on its undersurface preferably in the form of a zipper section 2 which is spaced inwardly of the side edges to extend from a common point at the foot end of the adaptor pad for substantially the entire length of the pad and terminating adjacent to the head end, as best seen from FIG. 1.

Figure 1:
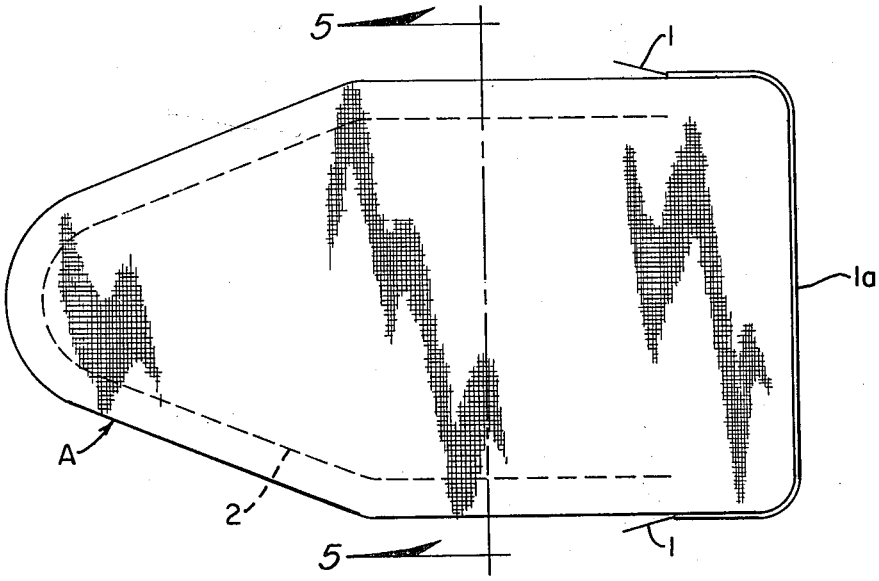
FIG. 1 is an elevational view of a preferred form of the adaptor viewed from underneath in order to show the zipper placement.
Figure 2:
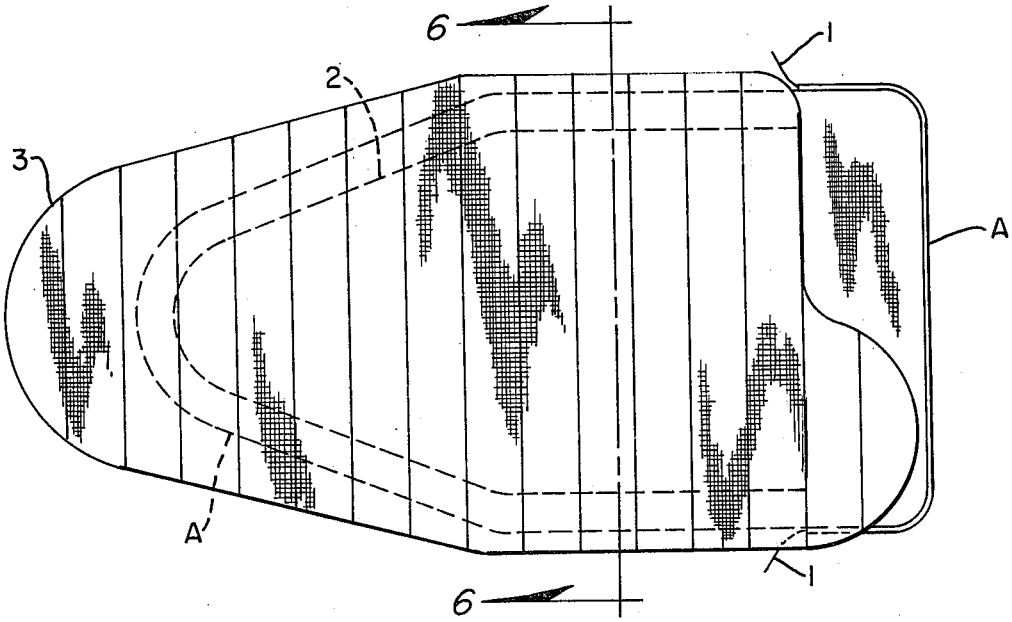
FIG. 2 is a top plan of the adaptor of FIG. 1 fastened to a conventional side-zipped mummy bag.
Figure 3:
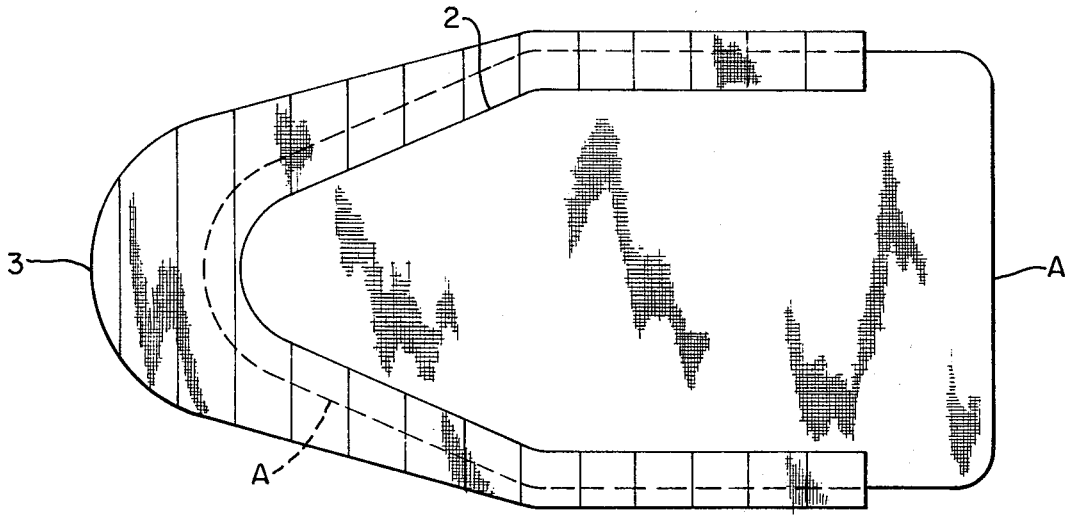
FIG. 3 is a view of the adaptor zipped to a mummy bag and viewed from underneath to show the shape of the opening and the way the adaptor fits into the mummy bag.

The adaptor pad is preferably dimensioned to be of a width sufficient to accommodate two persons in side-by-side relation and specifically is of a configuration and width to permit its insertion into the opening created by unzipping the zipper portion of the mummy bag, spreading it open, and folding or wrapping the unzipped edges of the mummy bag over the side edges of the adaptor pad and folding thereunder until the zipper portions of the mummy bag are aligned with the zipper section II of the adaptor pad, again as illustrated in FIG. 3. For the purpose of illustration and not limitation, the adaptor pad A may be approximately forty-five inches wide so as to allow two average-sized persons to lie comfortably side-by-side on the pad and the zipper section 2 may be set back from the longitudinal edges of the pad approximately four inches thereby creating a draft flap when joined with the side edges of the mummy bag to insure greater warmth between the bag and adaptor pad. In this manner, the mummy bag will completely cover the top surface and side edges of the adaptor pad so as to form a double bag construction.

Figure 4:
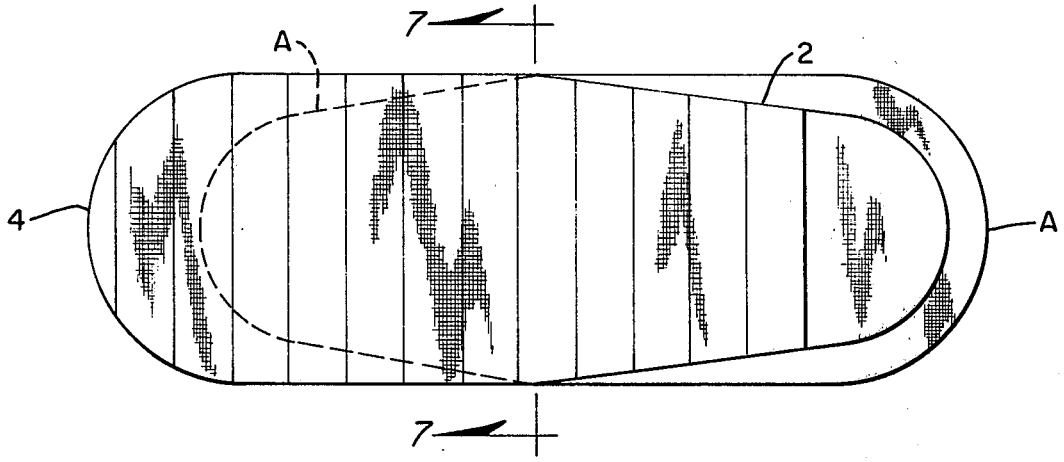
FIG. 4 is a top plan view of an insert zipped to the adaptor in forming a single mummy bag.
Figure 7:
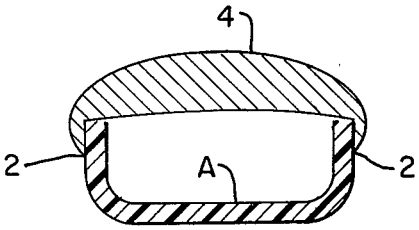
FIG. 7 is another cross-sectional view showing the insert zipped to the adaptor.

Thus, when used in combination, the adaptor pad has longitudinal edges extending along opposite sides as well as opposite end edges, the pad being of a length slightly less than the length of the panel portion of the mummy bag and of a width greater than the folded width of the panel portion but less than the unfolded width of the panel portions. The generally U-shaped zipper section defines removable fastener means affixed to the undersurface of the adaptor pad and spaced inwardly of the opposite side longitudinal edges and end edges and extending continuously therealong; and the zipper portions of the mummy bag along opposite longitudinal edges and end edges of the panel portions also form mating removable fastener means which can be folded over the side longitudinal edges and end edge of the adaptor pad with the removable fasteners on the panel portions secured to the fastener means on the pads and the panel portions extending across and above the surface of the adaptor pad A opposite to the undersurface. FIGS. 4 and 7 illustrate the conformability of the adaptor pad A for use with a special insert 4 to form a single bag. The insert 4 is nothing more than a sleeping bag of a reduced width in relation to that of the conventional bag but of a corresponding construction. A zipper extends around opposite coextensive longitudinal edges and at a tapered or rounded end which once again can be folded over the opposite side edges and foot end of the adaptor pad A. As best seen from FIG. 7, by virtue of the reduced width of the insert 4 its joinder along the zipper section with the adaptor pad A will cause the adaptor pad to be drawn up along its side edges. Similarly, the drawstring at the head end of the bag is drawn up so as to form a somewhat curved configuration of the adaptor pad at its head end. Further, as noted from FIG. 4, when the insert and pad are zipped together, the tapered end of the pad will lay somewhat flat but the head end be curled or rolled up slightly along its edges so as to more snugly fit around a single person lying on the pad and within the insert with the insert extending down over the foot end of the adaptor pad so as to completely surround and cover the feet. By virtue of utilization of the adaptor pad with a single panel portion or insert as described, such facilitates use of a pair of adaptor pads with a sleeping bag formed with two panel sections zipped together and separable into halves so that each half may be used independently with an adaptor pad as described and shown with respect to FIGS. 4 and 7.

Figure 8:
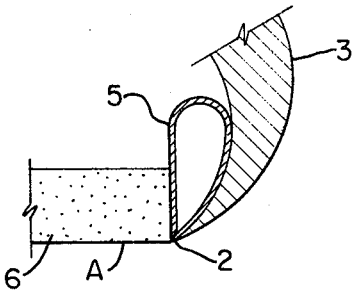
FIG. 8 is a somewhat fragmentary sectional view of an alternative method of construction using a separate draft flap.

FIG. 8 illustrates a somewhat modified form of adaptor pad-sleeping bag construction in which a draft flap 5 is inserted between the side edges of the adaptor pad and longitudinal edges of the mummy bag to create further insulation at the juncture between the bag and the pad. In this form, the bag is illustrated as being removably fastened or zipped to the lower corner edge of the adaptor pad, and most desirably the draft flap is permanently secured to opposite edges of the pad directly adjacent to the zipper portion. As illustrated, the draft flap may be composed of a foam-filled, polyester or downfill encased within a cover having the thickness as indicated.

Figure 9:
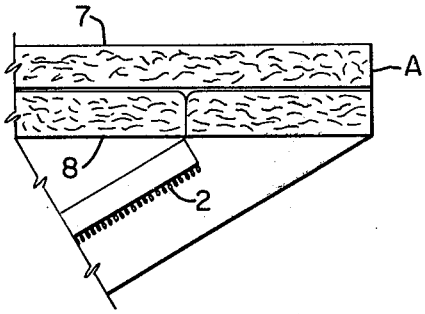
FIG. 9 is a cutaway view showing the filling material, zipper location and method of construction.

Still another modified form of adaptor pad A′ is illustrated in FIG. 9 wherein the pad 5 is composed of a synthetic fiber fill body in double layers separated by sheets of Nylon 8, and the zipper 2 sewn through one layer of the Nylon 8 in order to stabilize its position and minimize any tendency to become separate from the pad or stretched by the sleeping bag unless sewn directly to the inner portion of the pad as illustrated in FIG. 9.

Figure 10:
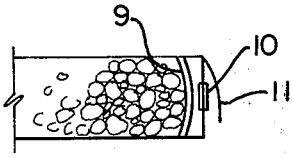
FIG. 10 is a somewhat fragmentary sectional view showing insertion of a ventilator therein.

Another modified pad construction is shown in FIG. 10 in which screen vents 10 are backed by one or more layers of a porous material 9 so as to permit water to pass through while preventing the down 12 from escaping. A cloth wind cover 11 is secured to the upper corner edge of the pad along opposite side edges to extend downwardly over the vents 10 so as to prevent loss of thermal efficiency which would otherwise occur during wind blowing through the vent. This modified form is of special value in the use of rip-stop Nylon and other tight weaves which resist the passage of water when wet. Utilization of the screened vents as described affords a means for venting the fiber and down-filled sleeping bags in order that wash water surging though the bag will not burst the seams. The vents also will permit air to escape when the bag is to be rolled or folded as well as to permit air to enter the pad when unfolded.

What is claimed is:

1. An adaptor pad for use with a sleeping bag of the type having at least one generally rectangular panel portion provided with removable fasteners extending at least along opposite longitudinal edges, said adaptor pad comprising:

a body portion having longitudinal edges on opposite sides thereof and opposite end edges, said body portion dimensioned to be of a length slightly less than the length of said panel portions and of a width less than the width of the panel portion, removable fastener means on the undersurface of said body portion spaced inwardly but adjacent to opposite side longitudinal edges thereof whereby to removably fasten the removable fasteners on the opposite longitudinal edges of said panel portion to the undersurface of said body portion to cover said adaptor pad with the opposite longitudinal edges of said panel portion folded over the opposite longitudinal edges and end edge of said body portion.

2. An adaptor pad according to claim 1, said pad being of a width substantially corresponding to the width of said panel portion so that said adaptor pad is curved upwardly along its opposite side edges to permit removable fastening of said panel portion to the removable fastener means on said adaptor pad.

3. An adaptor pad according to claim 1, said panel portion defined by two longitudinal halves folded together along a common longitudinal edge and provided with removable fasteners extending at least along opposite mating longitudinal edges for releasably securing said longitudinal edges of said panel portion together, said adaptor pad being of a width greater than the folded width of said panel portion but less than the unfolded width of said panel portions.

4. An adaptor pad according to claim 3, including a draft flap interposed between said adaptor pad and sleeping bag at the juncture between said fastener means and removable fasteners.

5. In combination, a sleeping bag and adaptor pad wherein the sleeping bag is of the type having generally rectangular panel portions folded along a common longitudinal edge into superimposed relation to one another and having removable fastener means extending at least along the opposite coextensive longitudinal edges and end edges for releasably securing said panel portions together, and said adaptor pad having longitudinal edges extending along opposite sides and opposite end edges, said pad dimensioned to be a length slightly less than the length of said panel portions and of a width greater than the folded width of said panel portions, removable fastener means affixed along opposite side longitudinal edges and end edges and extending therealong, opposite longitudinal edges and the end edges of said panel portions provided with removable fasteners being extended over the side longitudinal edges and the one end edge of said pad with the removable fasteners on said panel portions removably secured to said removable fastener means and said panel portions extending across and above the surface of said adaptor pad opposite to the undersurface containing said removable fastener means.

6. In the combination according to claim 5, each of said sleeping bags and adaptor pads including correspondingly tapered portions at the foot ends of said sleeping bag and adaptor pad, respectively, said adaptor pad having a drawstring at its head end and a draft flap interposed between the connected side edges and longitudinal edges of said adaptor pad and sleeping bag.

* * * * *

PO-1050
(5/69)

UNITED STATES PATENT OFFICE
CERTIFICATE OF CORRECTION

Patent No. 3,979,784 Dated 14 September 1976

Inventor(s) Richard A. Boothe

It is certified that error appears in the above-identified patent and that said Letters Patent are hereby corrected as shown below:

In The Specification:

Column 4, line 48, after "unfolded" insert the following paragraph:

--While there have been shown and described and pointed out fundamental and novel features of the invention as applied to a preferred embodiment, it will be understood that various omissions and substitutions and changes in the form and details of the device illustrated and in its operation may be made by those skilled in the art without departing from the spirit of the invention. It is the intention, therefore, to be limited only as indicated by the scope of the following claim:--

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*